US009947303B1

(12) United States Patent
Dulin

(10) Patent No.: US 9,947,303 B1
(45) Date of Patent: Apr. 17, 2018

(54) ADAPTER DEVICE FOR ATTACHING A STRAP TO A MUSICAL INSTRUMENT PROVIDED WITH A STRAP BUTTON

(71) Applicant: Michael H. Dulin, Bartow, FL (US)

(72) Inventor: Michael H. Dulin, Bartow, FL (US)

( * ) Notice: Subject to any disclaimer, the term of this patent is extended or adjusted under 35 U.S.C. 154(b) by 0 days.

(21) Appl. No.: 15/430,313

(22) Filed: Feb. 10, 2017

Related U.S. Application Data

(60) Provisional application No. 62/294,740, filed on Feb. 12, 2016.

(51) Int. Cl.

| | |
|---|---|
| ***G10G 5/00*** | (2006.01) |
| ***G10D 3/00*** | (2006.01) |
| ***A44B 13/00*** | (2006.01) |
| *A44B 11/00* | (2006.01) |
| *A44B 17/00* | (2006.01) |

(52) U.S. Cl.
CPC ..... *G10G 5/005* (2013.01); *A44B 13/0005* (2013.01); *G10D 3/00* (2013.01); *G10G 5/00* (2013.01); *A44B 11/00* (2013.01); *A44B 13/00* (2013.01); *A44B 17/00* (2013.01)

(58) Field of Classification Search
CPC G10G 5/005; G10G 5/00; G10D 3/00; G10D 3/163; A44B 13/0005; A44B 13/00; A44B 11/00; A44B 17/00
USPC ..... 84/327
See application file for complete search history.

(56) References Cited

U.S. PATENT DOCUMENTS 1,610,237 A * 12/1926 Belli ..... A44B 11/00 24/316
1,945,162 A * 1/1934 Rasmussen ..... G10G 5/005 84/327
2,540,784 A * 2/1951 Hocher ..... E04H 12/24 174/45 R
2,547,924 A * 4/1951 Citro ..... G10G 5/00 84/327

(Continued)

FOREIGN PATENT DOCUMENTS

CN 201307403 Y * 9/2009
CN 203982777 U * 12/2014

(Continued)

*Primary Examiner* — David Warren
*Assistant Examiner* — Christina Schreiber
(74) *Attorney, Agent, or Firm* — Gold & Rizvi, P.A.; H. John Rizvi

(57) ABSTRACT

An adapter device is disclosed for removably securing a carrying strap to a guitar or other musical instrument provided with a strap mounting button. The adapter device includes a housing defining a cavity for receipt of a clamp member movably mounted to the housing. The housing has a strap stud and a threaded nut for securing the housing to the carrying musical instrument. The clamp member has an elongate slot for receipt of a shaft of the mounting button of the musical instrument. The clamp member further includes an enlarged cavity for receipt of an enlarged circular head of the mounting button to prevent the mounting button from pulling out of the slot in the clamp member. A latch member is movably mounted to the housing and movable from an unlocking position to a locking position covering the clamp member and securing the clamp member within the cavity of the housing. tab is provided on the latch member to secure the latch member in the locking position.

20 Claims, 15 Drawing Sheets

(56) References Cited

U.S. PATENT DOCUMENTS 3,011,237 A * 12/1961 Prete, Jr. ..... A44B 11/12 24/170
3,239,115 A * 3/1966 Bott ..... B60R 9/12 224/315
3,357,613 A * 12/1967 Chase ..... A45F 3/14 224/162
3,631,572 A * 1/1972 Lange ..... A45C 11/38 224/257
3,935,782 A * 2/1976 O'Brien ..... G10H 3/18 224/910
4,144,794 A * 3/1979 Silverman ..... G10G 5/005 224/257
4,274,181 A * 6/1981 Schaller ..... G10G 5/005 224/257
4,291,822 A * 9/1981 Simonds ..... G10D 1/08 224/257
4,715,259 A * 12/1987 Wittman ..... G10D 3/00 224/910
4,843,943 A * 7/1989 Hoshino ..... G10D 3/00 224/910
4,901,900 A * 2/1990 Goto ..... A45F 3/14 224/257
4,993,127 A * 2/1991 Mechem ..... A45C 13/30 224/257
5,103,538 A 4/1992 Ryder
5,315,910 A * 5/1994 Soupios ..... G10D 1/085 84/263
5,540,368 A * 7/1996 Oliva ..... A45F 5/02 224/242
5,560,497 A * 10/1996 Mulvihill, Jr. ..... A47F 5/08 211/4
5,669,118 A * 9/1997 Frano ..... A44B 11/04 24/198
5,930,874 A * 8/1999 Yamazaki ..... A44B 11/10 24/419
6,032,339 A * 3/2000 D'Addario ..... A45C 13/1092 24/265 BC
6,080,922 A * 6/2000 Dimbath ..... G10G 5/005 84/327
6,169,238 B1 * 1/2001 Bolo ..... G10D 3/163 24/545
6,202,262 B1 3/2001 Hamburger, III
6,590,145 B2 7/2003 Doiron
6,687,964 B2 2/2004 Vanderpool
6,804,868 B2 * 10/2004 Fox ..... A44C 5/2042 24/116 A
7,045,694 B2 * 5/2006 Yasunori ..... A44B 11/2584 24/633
7,256,337 B1 * 8/2007 Walker ..... G10D 3/163 84/258
7,358,430 B2 * 4/2008 Tambara ..... G10G 5/005 411/913
D591,144 S * 4/2009 Hennessey ..... D8/387
7,562,422 B2 * 7/2009 D'Addario ..... G10G 5/005 24/701
7,818,851 B2 10/2010 Perrotta
7,888,572 B2 2/2011 Rosenberg et al.
8,436,240 B1 * 5/2013 Coady ..... F16B 5/0266 84/327
8,616,511 B2 * 12/2013 James ..... B63B 17/02 114/361
8,710,341 B2 * 4/2014 Bowen ..... G10G 5/005 84/327
8,813,315 B2 * 8/2014 Schultz ..... A44B 11/22 24/163 R
9,514,721 B1 * 12/2016 Champion ..... G10G 5/005
2008/0163738 A1 * 7/2008 Rosenberg ..... G10G 5/005 84/421
2010/0126329 A1 * 5/2010 Bowen ..... G10G 5/005 84/327
2011/0094071 A1 * 4/2011 Veldhoen ..... F16B 5/0692 24/598.4
2015/0221292 A1 * 8/2015 Piper ..... G10G 5/00 29/559
2017/0206871 A1 * 7/2017 Steinberger ..... G10G 5/005
2017/0301326 A1 * 10/2017 Truda ..... G10G 5/00

FOREIGN PATENT DOCUMENTS

FR 2845813 A1 * 4/2004 ..... G10G 5/005
GB 2444646 A * 6/2008 ..... G10G 5/005

* cited by examiner

ADAPTER DEVICE FOR ATTACHING A STRAP TO A MUSICAL INSTRUMENT PROVIDED WITH A STRAP BUTTON

CROSS-REFERENCE TO RELATED APPLICATIONS

This application claims the benefit of U.S. Provisional Patent Application Ser. No. 62/294,740, filed on Feb. 12, 2016, which is incorporated by reference herein in its entirety.

FIELD OF THE INVENTION

The present invention relates generally to sling or strap adapters for attaching a carrying strap to a musical instrument provided with a strap retaining button and, more particularly, to an adapter device for releasably attaching a carrying strap to a guitar or other musical instrument.

BACKGROUND OF THE INVENTION

Certain musical instruments such as guitars are often fitted with a carrying strap to facilitate the player carrying the instrument by passing the strap around his or her shoulders. Carrying straps come in various colors and formats, and often provide an ornamental complement to the musical instrument, in addition to carrying the instrument.

Carrying straps are typically attached to the musical instrument by positioning a hole in the carrying strap over a stud or a button on the musical instrument and securing the strap to the button. Typically, hardware is provided on the strap to secure the strap to the musical instrument, but specific hardware often requires dedicated, associated buttons be installed on the musical instrument which can damage the surface and finish of the musical instrument.

When using one or more musical instruments, it is often desirable to be able to exchange carrying straps between the instruments or exchange different carrying straps on a single instrument. However, the dedicated hardware and button combinations limit the ability of a musician to exchange the carrying straps between various musical instruments and make it difficult to set up a single musical instrument with a variety of different carrying straps. Thus, in practice, coupling a specific hardware to a differing mounting button on the musical instruments may provide a loose fit between the hardware and button that may cause the mounting hardware to inadvertently release from the button and the strap to release from the musical instrument.

Accordingly, there is an established need for a carrying strap hardware that is attachable to a variety of mounting buttons on musical instruments.

SUMMARY OF THE INVENTION

The present invention is directed to a simple and convenient adapter device or strap adapter for quickly and easily securing a carrying strap to a musical instrument, such as a guitar, having a mounting button or stud. The adapter device generally includes a housing defining a cavity for receipt of a clamp member movably mounted to the housing. The housing has a strap stud for securing the carrying strap to the housing. The clamp member defines an elongate slot for receipt of a shaft of the mounting button of the musical instrument. The clamp member can further include an enlarged cavity for receipt of an enlarged head of the mounting button. A seating surface of the clamp member retains the enlarged head of the mounting button within the enlarged cavity of the clamp member. A latch member is provided and is movably mounted to the housing and movable from an unlocking position allowing the clamp member to move, to a locking position covering the clamp member and securing the clamp member within the cavity of the housing. A tab can be provided on the latch member to secure the latch member in the locking position.

In a first implementation of the invention, an adapter device for removably securing a carrying strap to a mounting button of a musical instrument comprises a housing, a clamp member and a latch member, wherein the clamp member and latch member are movably mounted to the housing. The housing comprises a frontward-oriented cavity which is delimited by a rear wall arranged rearward of the cavity. A strap stud extends rearward from the rear wall of the housing. The clamp member includes an elongated, through slot. The slot has a width less than a width of the cavity. The clamp member is reversibly movable relative to the housing from a closed position to an open position. In the closed position, the clamp member and slot are at least partially positioned within the cavity of the housing, and a space is delimited within the cavity, wherein the space is arranged rearward of and in communication with the slot and is wider than the slot. In the open position, the clamp member is moved away from the housing and the cavity is exposed to a greater extent than in the closed position, allowing the insertion of a mounting button into the cavity. In turn, the latch member is movable from an unlocking position moved away from the clamp member and allowing the clamp member to move relative to the housing to a locking position covering a portion of the clamp member in the closed position and retaining the clamp member in the closed position.

In a second aspect, the slot can be delimited by opposite inner side walls of the clamp member, and the clamp member can further include a seating surface forming an angle other than zero with the opposite inner side walls and facing the space when the clamp member is in the closed position.

In another aspect, an inner end of the slot can be delimited by a rounded end wall.

In another aspect, the clamp member can further include an enlarged cavity adjacent to the slot and arranged rearward of the slot when the clamp member is in the closed position.

In another aspect, at least one of the clamp member and the latch member can be pivotably connected to the housing. For instance, the clamp member can be pivotable relative to the housing about a rotation axis arranged along a left-to-right, lateral direction of the housing. In turn, the latch member can be pivotable relative to the housing about a rotation axis arranged along a front-to-back, longitudinal direction of the housing. In some embodiments, both the clamp member and the latch member are pivotable relative to the housing, about respective rotation axes which can be perpendicular to one another. In some embodiments, the clamp member can further include a tapered surface on a base portion of the clamp member, the tapered surface configured to engage the housing to limit the pivoting of the clamp member away from the housing.

In another aspect, the strap stud can be at least partially threaded. For instance, the strap stud can include a non-threaded portion extending from the rear wall of the housing and a threaded portion extending rearward from the non-threaded portion. The non-threaded portion of the strap stud can include a shoulder extending from the rear wall of the housing, wherein the shoulder is arranged rearward of the latch member when the latch member is in the locking position.

In yet another aspect, the clamp member can include a base portion, a first arm extending from the base portion and a second arm extending from the base portion, the first and second arms defining the elongated slot therebetween.

In another aspect, the latch member can include a front side which at least partially covers the first and second arms of the clamp member when the clamp member is in the closed position and the latch member is in the locking position.

In another aspect, the housing can further include a notch in an outer surface of the housing. In turn, the latch member can further include an inward protrusion engageable with the notch when the latch member is in the locking position.

In another aspect, the housing can further include a downward projecting rib extending from a top side of the housing. When the clamp member is in the closed position, the downward projecting rib extends into the slot.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an adapter device for attaching a strap to a musical instrument provided with a strap button. The adapter device can be disconnectably secured to the strap button and can accommodate to various button configurations.

Figure 1:
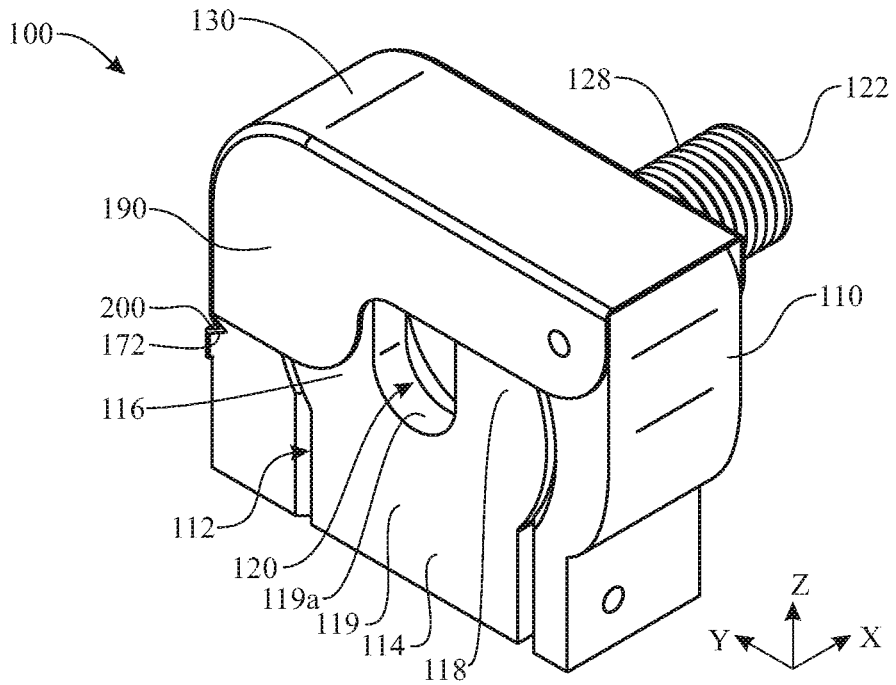
FIG. 1 presents an isometric top front view of an adapter device in accordance with an exemplary embodiment of the present invention.
Figure 2:
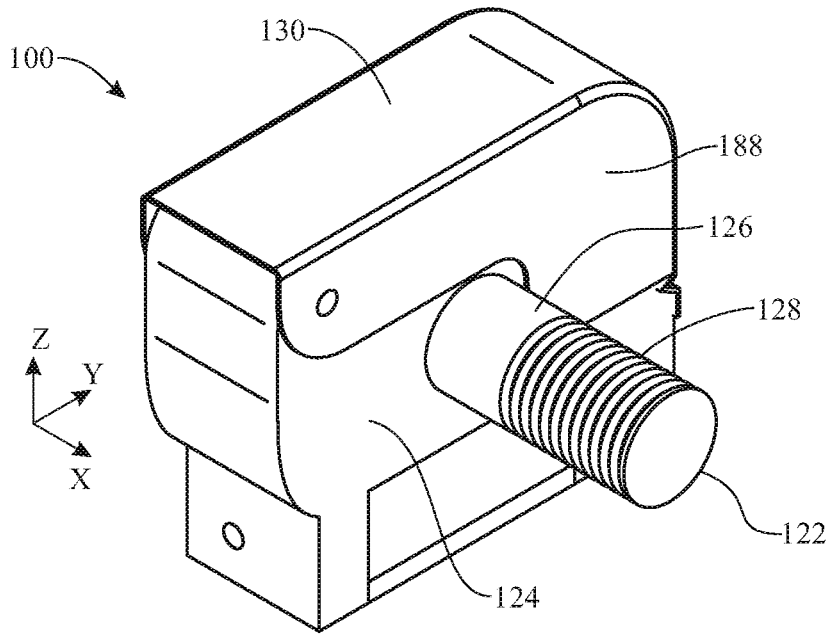
FIG. 2 presents an isometric top rear view of the adapter device of FIG. 1.

Referring initially to FIGS. 1 and 2, there is disclosed an adapter device 100 in accordance with a first illustrative implementation of the invention, for releasably attaching a carrying strap to a guitar or other musical instrument. Throughout the present description, reference will be made to a front-to-back, longitudinal direction X, a side-to-side or left-to-right, lateral direction Y and an up-and-down or top-to-bottom, transverse direction Z. The adapter device 100 includes a generally rectangular housing 110 defining a central cavity 112 and clamp member 114 movably mounted to the housing 110. More specifically, in some embodiments (such as the present embodiment), the clamp member 114 is pivotably attached to the housing 110. The clamp member 114 includes a first arm 116 and a second arm 118 which extend in a spaced apart relationship with one another from a base portion 119. The base portion 119, first arm 116 and second arm 118 together form a U-shaped body and define an elongated slot 120 therebetween for receipt of a mounting stud or button of a guitar or other musical instrument (not shown) as described in more detail hereinbelow. The slot 120 is delimited by an inner side wall 116*a* of the first arm 116, an inner side wall 118*a* of the second arm 118, and an inner wall 119*a* of the base portion 119. The inner side walls 116*a*, 118*a* of the present embodiment are parallel to one another, planar and perpendicular to the lateral direction Y. Preferably, the slot 120 has a rounded inner end defined by the rounded inner wall 119*a* of the base portion 119. A strap stud 122 extends from a rear surface 124 of the housing 110 and is provided to receive and secure an end of a carrying strap to the adapter device 100. The strap stud 122 includes a non-threaded, smooth portion 126 and a threaded portion 128. The adapter device 100 additionally includes a latch member 130 which is movably mounted to the housing 110 and is provided to secure the clamp member 114 in a closed position within the housing 110. More specifically, in some embodiments (such as the present embodiment), the latch member 130 is pivotably attached to the housing 110.

Figure 3:
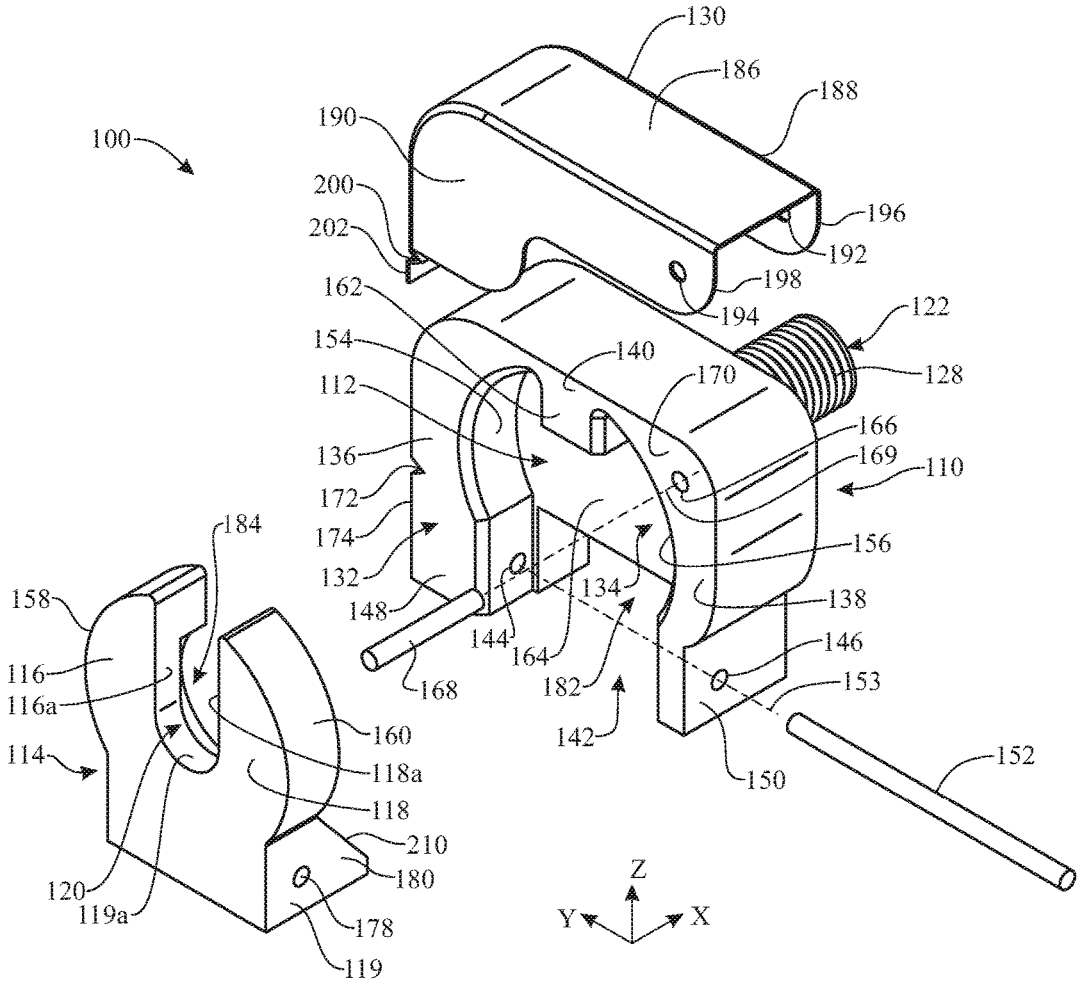
FIG. 3 presents an isometric top front exploded view of the adapter device of FIG. 1.

Referring now to FIG. 3, the housing 110 includes a front portion 132 including the central cavity 112 for receipt of the clamp member 114, and a solid rear portion 134. The front portion 132 of the housing 110 includes solid first and second sides 136 and 138, a solid top side 140 and an open bottom side 142, wherein the central cavity 112 is delimited by the first, second, top and bottom sides 136, 138, 140 and 142. Pivot holes 144, 146 are provided through lower ends 148, 150 of the first and second sides 136 and 138, respectively, to receive a clamp pin 152 for pivotally mounting the clamp member 114 to the housing 110. The pivot holes 144, 146 and clamp pin 152 define a rotation axis 153 of the clamp member 114 relative to the housing 110. The first and second sides 136 and 138 of the present embodiment have curved inner surfaces 154 and 156 which correspond to curved outer surfaces 158 and 160, respectively, of the first and second arms 116 and 118 of the clamp member 114. The top side 140 of the housing 110 includes a downward projecting rib 162 extending downwardly into the central cavity 112 and configured to project into the slot 120 when the clamp member 114 is in the closed position. The rear portion 134 includes a front surface 164 against or towards which the clamp member 114 can close, and a rear surface which provides the rear surface 124 (FIG. 2) of the housing 110 from which the strap stud 122 extends.

With continued reference to FIG. 3, the housing 110 additionally includes a latch pivot hole 166 to receive a latch pin 168 and pivotably mount the latch member 130 to the housing 110. The latch pivot hole 166 extends through an upper, right-hand end 170 of the second side 138 of the front portion 132 and through the rear portion 134 of the housing 110. The latch pivot hole 166 and latch pin 168 define a rotation axis 169 of the latch member 130 relative to the housing 110. A notch 172, also shown in FIG. 6, is provided in an outer surface 174 of the first side 136 of the front portion 132 of the housing 110 to aid in securing the latch member 130 over the clamp member 114 in the closed position.

As noted above, the clamp member 114 includes respective first and second arms 116 and 118 extending upward from the base portion 119 of the clamp member 114. The base portion 119 includes a transverse, elongated pivot hole 178 to receive the clamp pin 152 and pivotally mount the clamp member 114 to the housing 110. The base portion also includes a tapered rear portion 180 which is positioned within a cut out portion 182 in the rear portion 134 of the housing 110. The tapered rear portion 180 is configured to engage the rear portion 134 of the housing 110 to limit the amount the clamp member 114 pivots away from the housing 110, as will be described in greater detail hereinafter.

Figure 6:
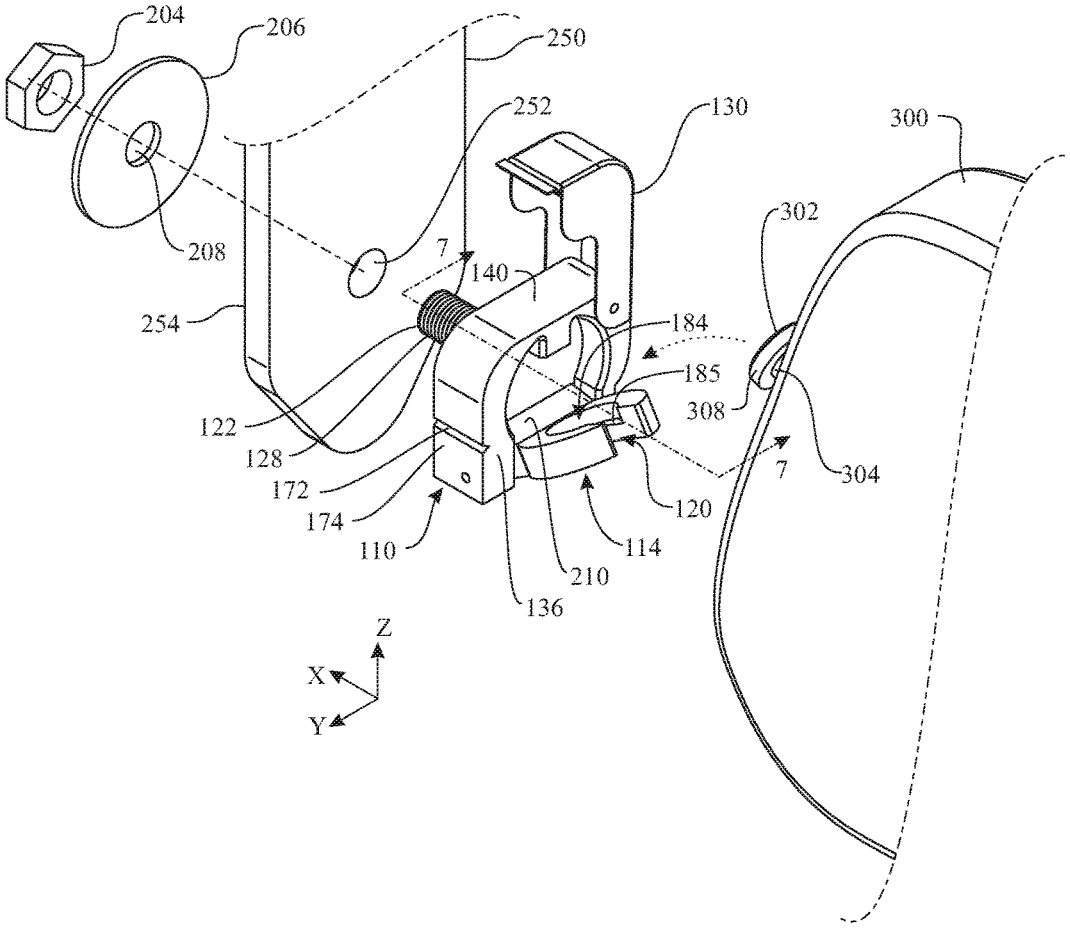
FIG. 6 presents an isometric view, with parts separated, of the adapter device of FIG. 1, a guitar strap and a guitar provided with a strap button, prior to assembly.

As best shown in FIG. 6, in order to secure and hold a mounting button of a guitar or other musical instrument, the clamp member 114 further includes an enlarged cavity 184 located directly behind the slot 120 and facing the rear portion 134 of the housing 110. By enlarged, it is understood that the enlarged cavity 184 is wider than the slot 120 (the width of the slot 120 being understood to be the distance between the inner side wall 116*a* of the first arm 116 and the inner side wall 118*a* of the second arm 118). The clamp member 114 further comprises a seating surface 185 facing the enlarged cavity 184, and arranged forming an angle other than zero with the slot 120 (more specifically, perpendicularly to the inner side walls 116*a*, 118*a* forming the slot 120) and partially encircling the slot 120. The enlarged cavity 184 is provided to receive an enlarged head of a mounting button, while the seating surface 185 is provided to retain the enlarged head within the enlarged cavity 184, as described in more detail hereinbelow. It should be noted that the slot 120 and enlarged cavity 184 are sized to receive a variety of differing sizes of mounting hardware provided on musical instruments thereby enabling the disclosed adapter device 100 to be a "universal" strap adapter device.

The latch member 130 is provided to secure the clamp member 114 within the central cavity 112 of the housing 110 when the clamp member 114 is pivoted to the closed or second position within the central cavity, as best shown in FIG. 1. As shown in FIG. 3, the latch member 130 depicted herein includes a generally L-shaped back portion 186 and first and second sides 188 and 190 extending from the back portion 186, in a spaced apart relationship defining a space therebetween. Pivot holes 192 and 194 extend through proximal, pivot ends 196 and 198 of the first and second sides 188 and 190 respectively for receipt of the latch pin 168. An inward protrusion or tab 200 is provided in a distal, free or bottom end 202 of the back portion 186 and is engageable in snap fit fashion within the notch 172 in the housing 110 to secure the latch member 130 in a closed position over the clamp member 114.

The adapter device 100, including its various components, may be formed from a variety of materials such as, for example, metallic materials such as stainless steels, plastics or polymers, or even hardwoods to match the subject musical instrument. Preferably, the latch member 130 is formed from a metallic or plastic material such that the back portion 186 in the area of the tab 200 is relatively flexible.

Figure 4:
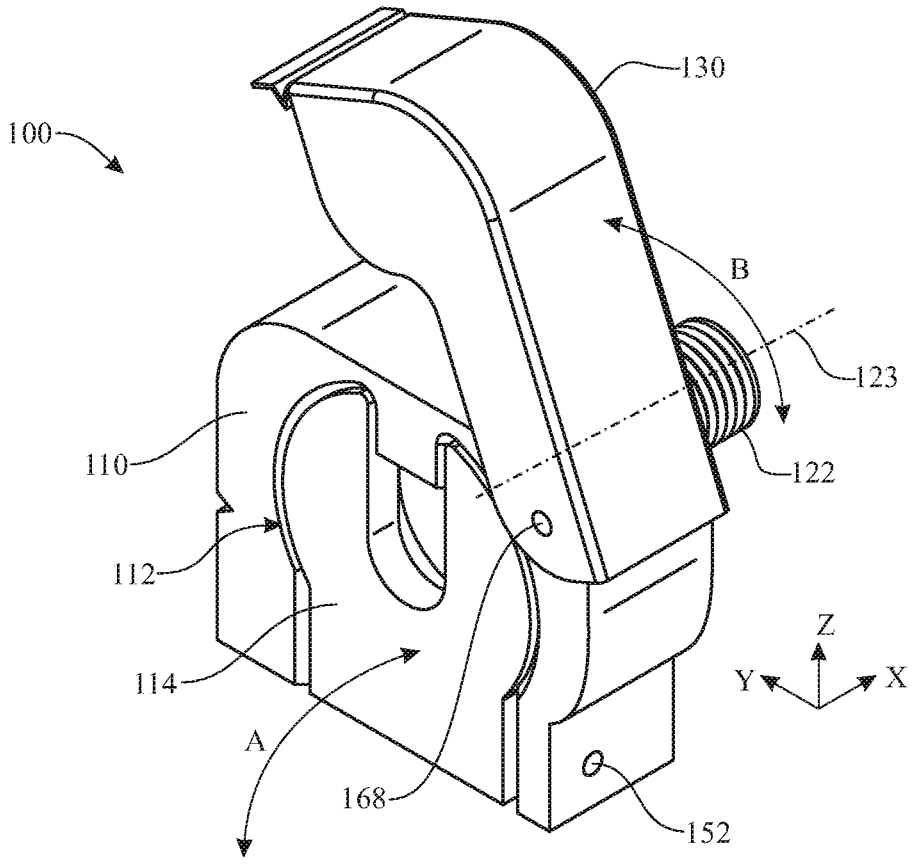
FIG. 4 presents an isometric top front view of the adapter device of FIG. 1 in a partially open and unlocked position.

Referring to FIG. 3, as shown, the pivot holes 144 and 146 through the housing 110 are generally perpendicular to the latch pivot hole 166 through the housing 110. Thus, the clamp pin 152 is arranged generally perpendicular to the latch pin 168, and the rotation axis 153 of the clamp member 114 is perpendicular to the rotation axis 169 of the latch member 130. As best shown in FIG. 4, this relative arrangement of the rotation axes 153, 169 causes the clamp member 114 to move, rotate and pivot in a first direction relative to the housing 110 in the direction of arrow "A" and the latch member 130 move, rotate and pivot in a second direction relative to the housing 110 in the direction of arrow "B", where arrows "A" and "B" are situated on respective planes that are perpendicular to one another. This relative perpendicular movement of the clamp member 114 and the latch member 130 allows the latch member 130 to move down over the clamp member 114 in "clamshell" fashion and thereby secure the clamp member 114 within the central cavity 112 in the housing 110, while providing a relatively compact and small-sized adapter device 100. More specifically, in the present embodiment, the rotation axis 153 is arranged in the lateral direction Y, and thus the clamp member 114 rotates frontward or rearward on a longitudinal, transverse plane (i.e. a plane encompassing the longitudinal and transverse directions X and Z); in turn, the rotation axis 169 is arranged in the longitudinal direction X, and thus the latch member 130 rotates sideways on a lateral, transverse plane (i.e. a plane encompassing the lateral and transverse directions Y and Z). With specific reference to FIG. 4, it should be noted that the clamp member 114 pivots in a direction (arrow "B") or plane that is also perpendicular to a longitudinal axis 123 of the strap stud 122.

Turning now to FIGS. 5 through 8, the use of the adapter device 100 to secure a guitar sling or strap 250 to a guitar 300 and, more specifically, to a mounting button 302 of the guitar 300, will now be described.

Figure 5:
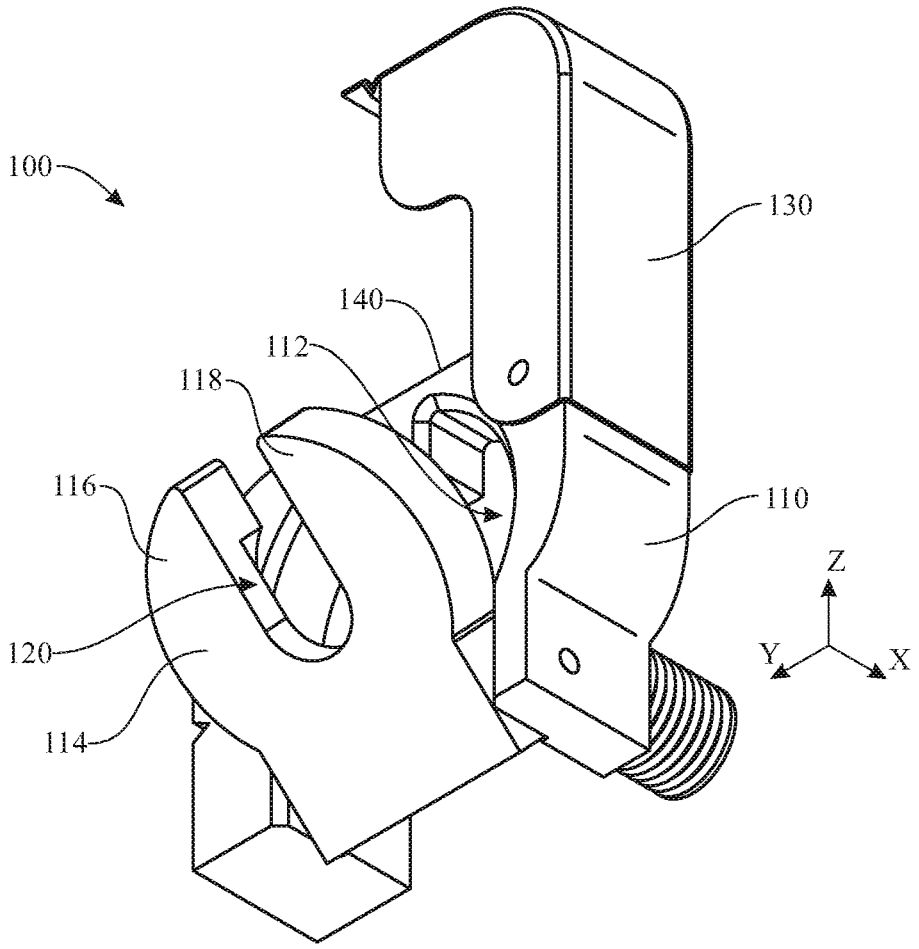
FIG. 5 presents an isometric bottom front view of the adapter device of FIG. 1 in a fully open and unlocked position.

As shown in FIG. 5, in an initial open and unlocked first position, the clamp member 114 is pivoted away from the central cavity 112 in the housing 110 and the latch member 130 is in an unlocking position pivoted up and away from the top side 140 of the housing 110.

Figure 8:
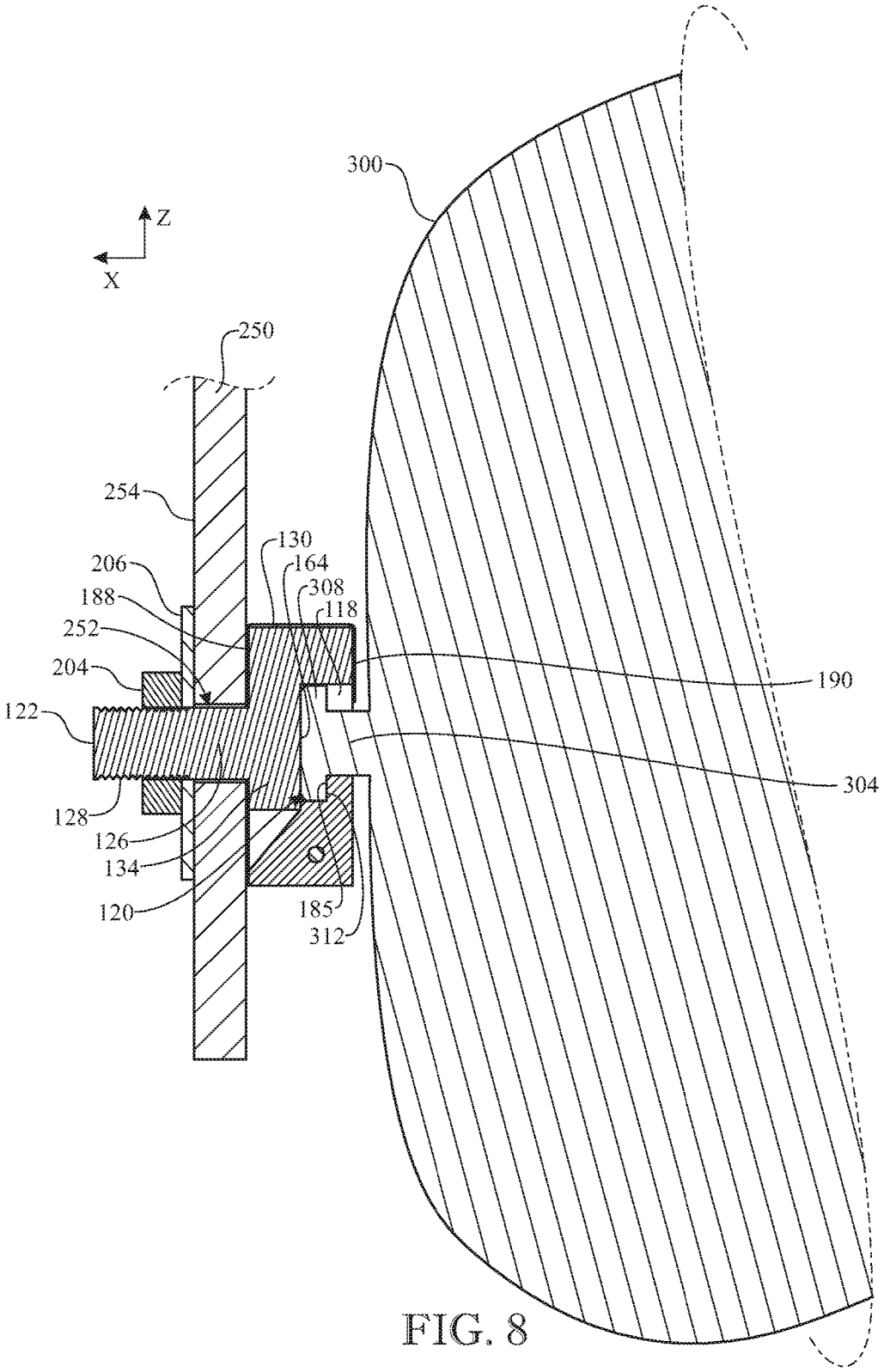
FIG. 8 presents an enlarged cross-sectional side elevation view of the adapter device fully attached to the guitar strap and in a closed and locked condition over the strap button of the guitar.
Figure 9:
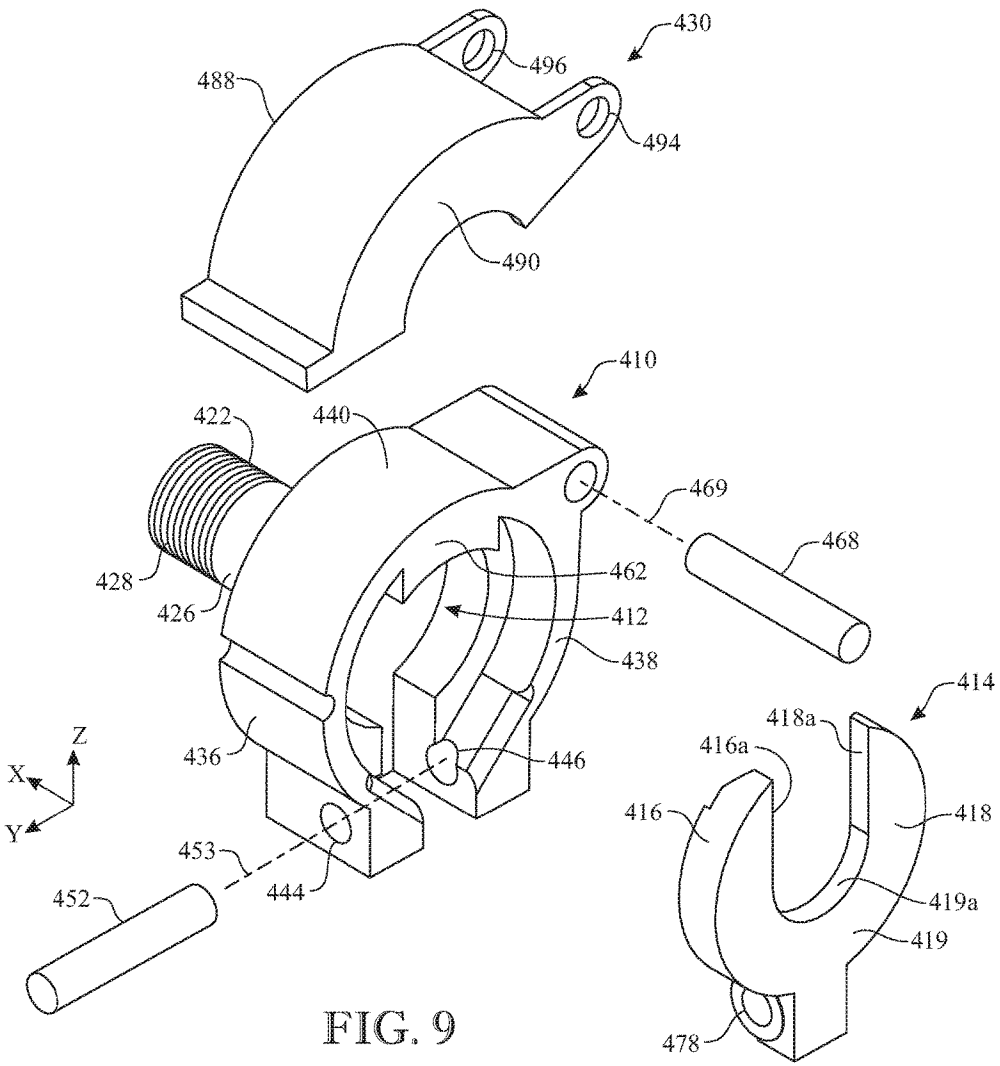
FIG. 9 presents an exploded, top front isometric view of an adapter device in accordance with a second illustrative embodiment of the present invention.

Referring to FIGS. 6 and 8, the guitar strap 250 is attached to the adapter device 100 by inserting the strap stud 122 of the adapter device 100 through a hole 252 formed through a supporting end 254 of the guitar strap 250. Thereafter, the adapter device 100 is firmly secured to the guitar strap 250 by threading a securing nut 204 over a section of the threaded portion 128 of the strap stud 122 which protrudes rearward from the supporting end 254 of the guitar strap 250. As best shown in FIG. 8, the guitar strap 250, and in particular the supporting end 254 of the guitar strap 250, preferably surrounds the smooth portion 126 of the strap stud 122 to avoid damage to the supporting end 254 by the threaded portion 128 of the strap stud 122. This prevents tearing of the supporting end 254 of the guitar strap 250 during use. As further shown, the adapter device 100 may additionally include a supporting washer 206 provided with a hole 208. The supporting washer 206 is positioned over the strap stud 122 and between the securing nut 204 and the supporting end 254 of the guitar strap 250. The supporting washer 206 can prevent the securing nut 204 from digging into the guitar strap 250.

Figure 7:
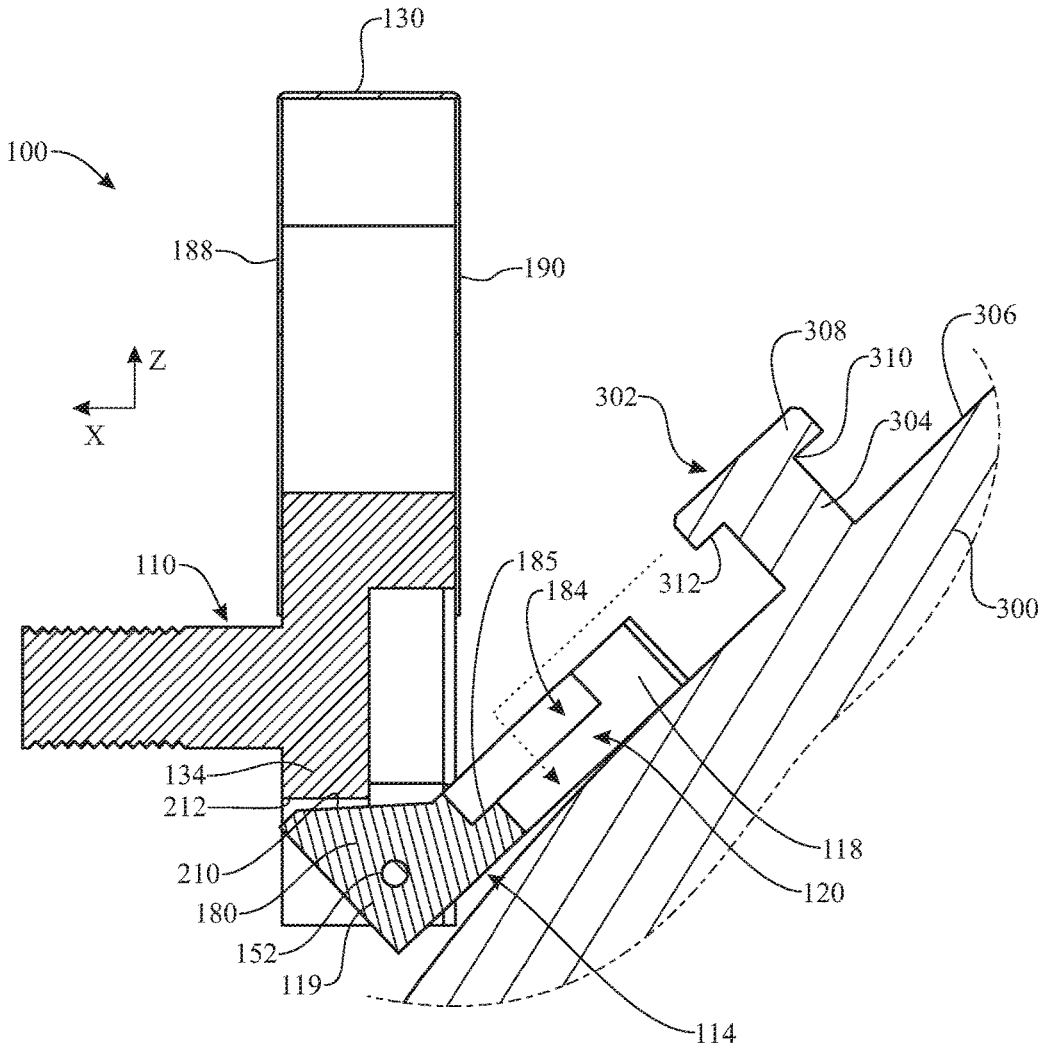
FIG. 7 presents a cross-sectional side elevation view of the adapter device receiving the strap button of the guitar, the section taken along a vertical section plane indicated by section line 7-7 in FIG. 6.

Referring now to FIGS. 6 through 8, as has been mentioned the clamp member 114 is initially pivoted away from the housing 110. As best shown in FIG. 7, a tapered face 210 on the tapered rear portion 180 of the base portion 119 of the clamp member 114 is configured to eventually engage an upper surface 212 defining the cut out portion 182 of the rear portion 134 of the housing 110 when the clamp member 114 is sufficiently pivoted outward from the housing 110. This limits the amount the clamp member 114 can pivot away from the housing 110 and facilitates using the adapter device 100. A user can thus place the clamp member 114 in a pivoted position, such as but not limited to the maximum pivoted position given by the tapered face 210 of the clamp member 114 contacting the upper surface 212 of the housing 110. Once the clamp member 114 is extended outward, the clamp member 114 is in position to receive the mounting button 302 of the guitar 300. As best shown in FIG. 7, the mounting button 302 generally includes a shaft 304 extending outward from an outer surface 306 of the guitar 300 and an enlarged head 308 (enlarged being understood as wider than the shaft 304), for instance an enlarged circular head, formed at an end 310 of the shaft 304. The enlarged head 308 presents an underside 312 which normally encircles the shaft 304 and is generally perpendicular to the shaft 304.

To attach the adapter device 100 to the guitar 300, the mounting button 302 is advanced toward the clamp member 114 such that the shaft 304 of the mounting button 302 is slid into the slot 120 of the clamp member 114 and the enlarged head 308 of the mounting button 302 is received within the enlarged cavity 184 of the clamp member 114. Once the mounting button 302 has been properly positioned within the clamp member 114, the clamp member 114 is pivoted inward in the direction of arrow "A" (FIG. 4) into a second or closed position such that the first and second arms 116 and 118 are contained within the central cavity 112 of the housing 110 (as explained heretofore with reference to FIG. 4). In this second or closed position, shown in FIG. 8, the shaft 304 of the mounting button 302 extends through the slot 120; in addition, the enlarged head 308 of the mounting button 302 is retained within the enlarged cavity 184, between the front surface 164 of the rear portion 134 of the housing 110, the first and second arms 116 and 118 of the clamp member 114 and the seating surface 185 of the clamp member 114. In this position, the seating surface 185 is arranged facing the underside 312 of the enlarged head 308 of the mounting button 302, and by contacting said underside 312 in the event of an outward pulling on the mounting button 302 relative to the adapter device 100, blocks the enlarged head 308 from slipping out of the enlarged cavity 184. In this closed position, the downward projecting rib 162 extends into the slot 120 to reduce the effective length of the slot 120 and contribute to retain the mounting button 302 in place. Preferably, the enlarged cavity 184 is sufficiently wider than the enlarged head 308 of the mounting button 302 and the slot 120 is sufficiently wider than the shaft 304 of the mounting button 302, allowing the adapter device 100 to rotate relative to the secured, mounting button 302. The slot 120 having a rounded inner end defined by the rounded inner wall 119*a* of the base portion 119 further facilitates smooth rotation of the shaft 304 within the slot 120.

With reference to FIGS. 1, 4 and 8, to secure the clamp member 114 within the central cavity 112 of the housing 110 in this second or closed position, the latch member 130 is then pivoted in the direction of arrow "B" towards the top side 140 of the housing 110, to a locking position shown in FIGS. 1, 2 and 8. In this locking position, the latch member 130 is closed down over, and covers a portion of, the central cavity 112 and the clamp member 114 within the central cavity 112. Specifically, the second side 190 of the latch member 130 covers and blocks the first and second arms 116 and 118 from moving out of the central cavity 112 thereby firmly locking the clamp member 114 to the housing 110. It should be noted that, as shown in FIG. 1, in this locking position of the latch member 130, the tab 200 on the latch member 130 enters the notch 172 formed in the housing 110 to secure the latch member 130 in the locking position.

As can be observed, the enlarged cavity 184 and the slot 120 of the clamp member 114 are not required to precisely adjust to the enlarged head 308 and the shaft 304 of the mounting button 302 in order for the adapter device 100 to retain the mounting button 302. Instead, the mounting button 302 remains secured by the clamp member 114 as long as the enlarged head 308 and the shaft 304 are able to fit into the enlarged cavity 184 and the slot 120, respectively, and the enlarged head 308 is wider than the slot 120 is order for the enlarged head 308 to be retained by the seating surface 185 of the clamp member 114. Thus, the adapter device 100 can be manufactured in accordance with a sufficiently large dimension in order to accommodate and retain many different sized and shaped mounting buttons.

When it is desired to remove the guitar strap 250 from the guitar 300, the slightly flexible tab 200 of the latch member 130 is simply pivoted away from the housing 110 and out of the notch 172 releasing the latch member 130 for movement to the unlocking position and the clamp member 114 is free to be moved back into the initial open and unlocked first position (FIG. 7) to release the mounting button 302 of the guitar 300.

The illustrations of FIGS. 9 through 16 show an adapter device 400 in accordance with a second illustrative implementation of the invention, for releasably attaching a carrying strap to a guitar or other musical instrument. Except as indicated otherwise, like features of the adapter device 400 and the adapter device 100 of FIGS. 1 through 8 are numbered analogously by adding three-hundred (300) to the reference numerals of the adapter device 100. The adapter device 400 includes a housing 410 having a first side 436, a second side 438 and a top side 440 defining a central cavity 412, and including a downward projecting rib 462 protruding from the top side 440 of the housing 410 into the central cavity 412. A generally U-shaped clamp member 414 is pivotably connected to the housing 410 by a clamp pin 452 extending through holes 478, 444, 446 in the clamp member 414 and bottom sides of the housing 410, thereby defining the rotation axis 453 of the clamp member 414. A top latch member 430, in turn, is pivotably connected to the housing 410 by a latch pin 468 extending through holes 492, 494, 466 in the latch member 430 and housing 410, thereby defining the rotation axis 469 of the latch member 430. The clamp member 414 is rotatable about a rotation axis 453 arranged in a lateral direction Y, so that the clamp member 414 can rotate as indicated by arrow "A" in FIG. 11. The latch member 430 is rotatable about a rotation axis 469 arranged in a longitudinal direction X so that the latch member 430 can rotate as indicated by arrow "B". The clamp member 414 is pivotable between a closed position shown in FIG. 11 and an open position shown in FIG. 12.

Figure 10:
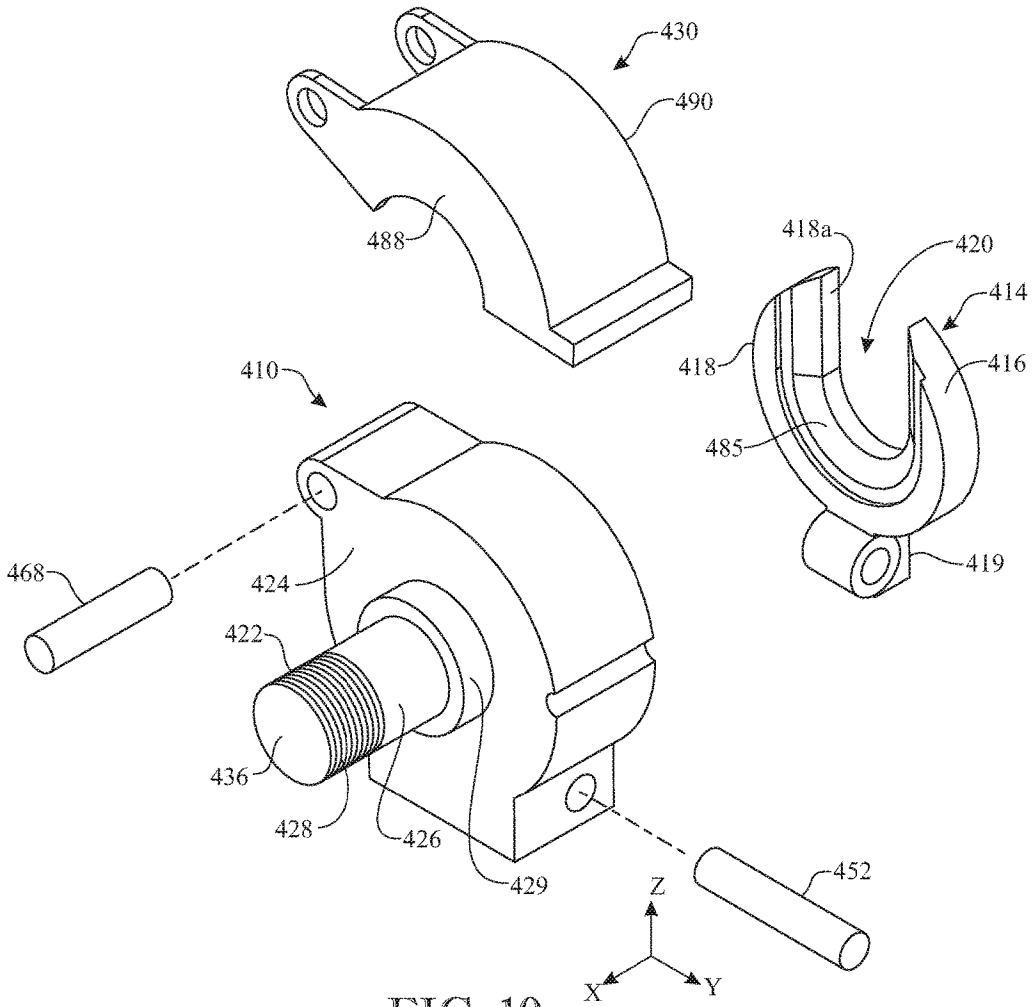
FIG. 10 presents an exploded, top rear isometric view of the adapter device of FIG. 9.
Figure 14:
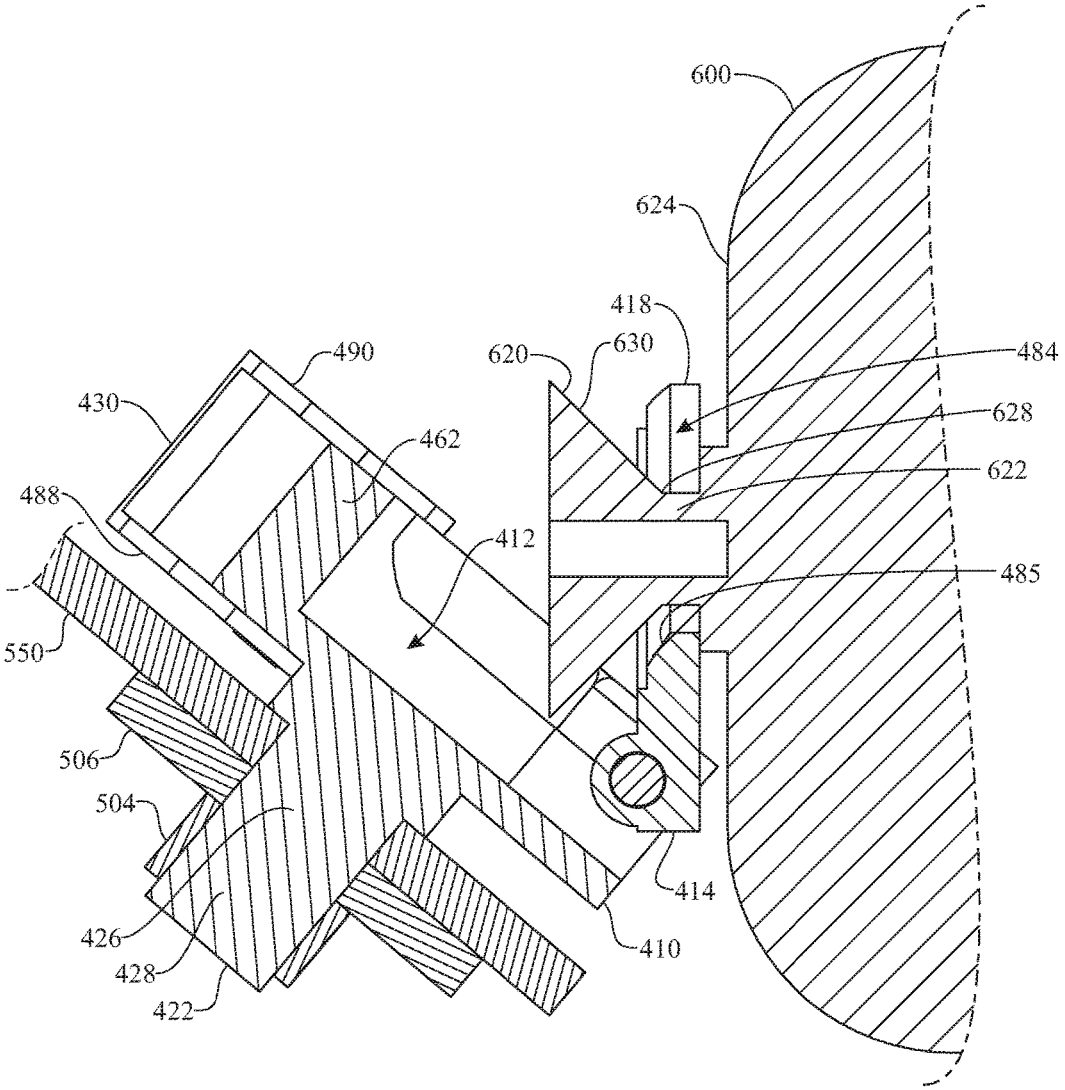
FIG. 14 presents a cross-sectional, side elevation view of the assembly of FIG. 11, being attached to a mounting button of a guitar.
Figure 15:
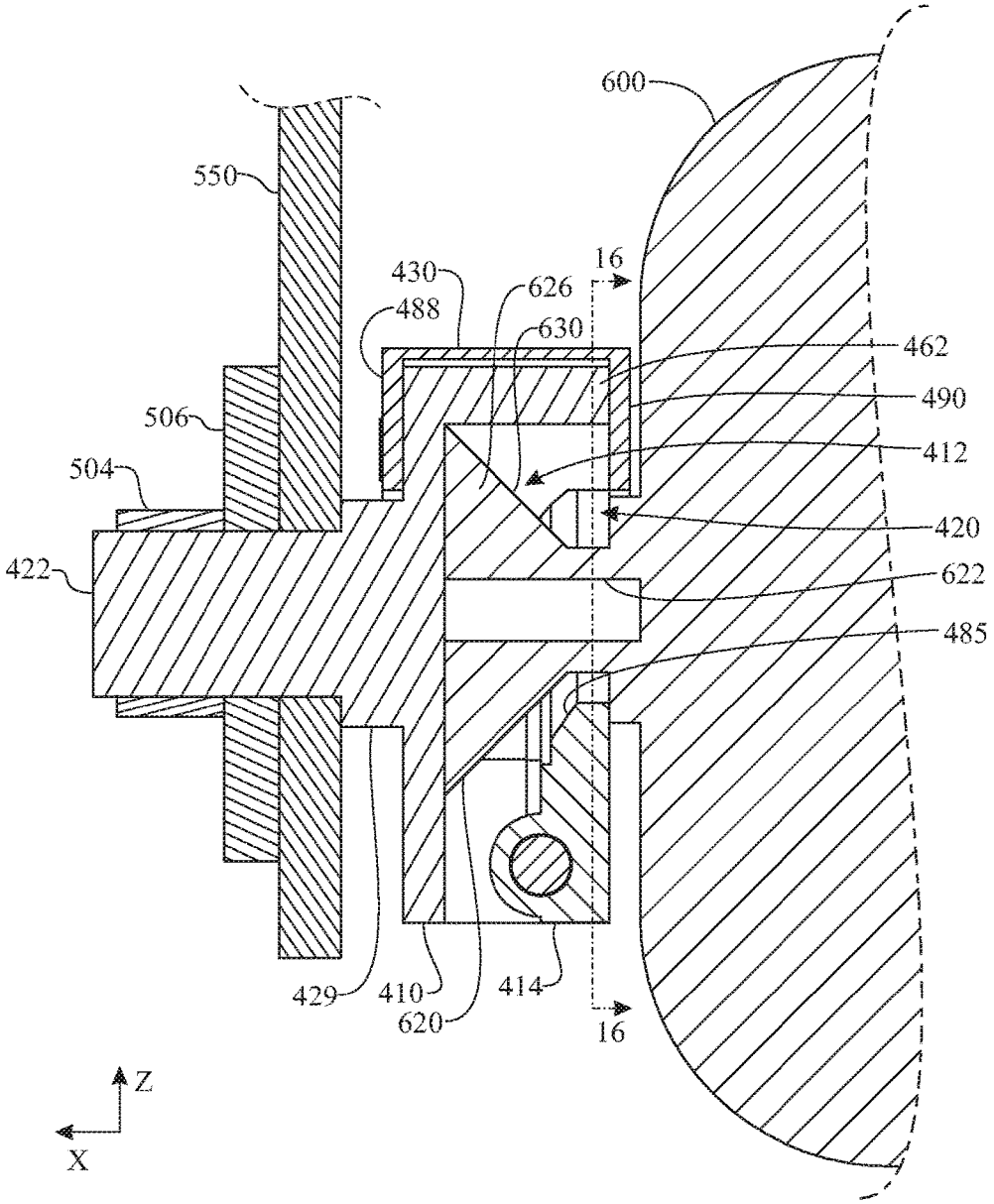
FIG. 15 presents a cross-sectional, side elevation view of the assembly of FIG. 14, with the clamp member in a closed position securing the mounting button, and with the latch member in a closed position securing the clamp member.
Figure 16:
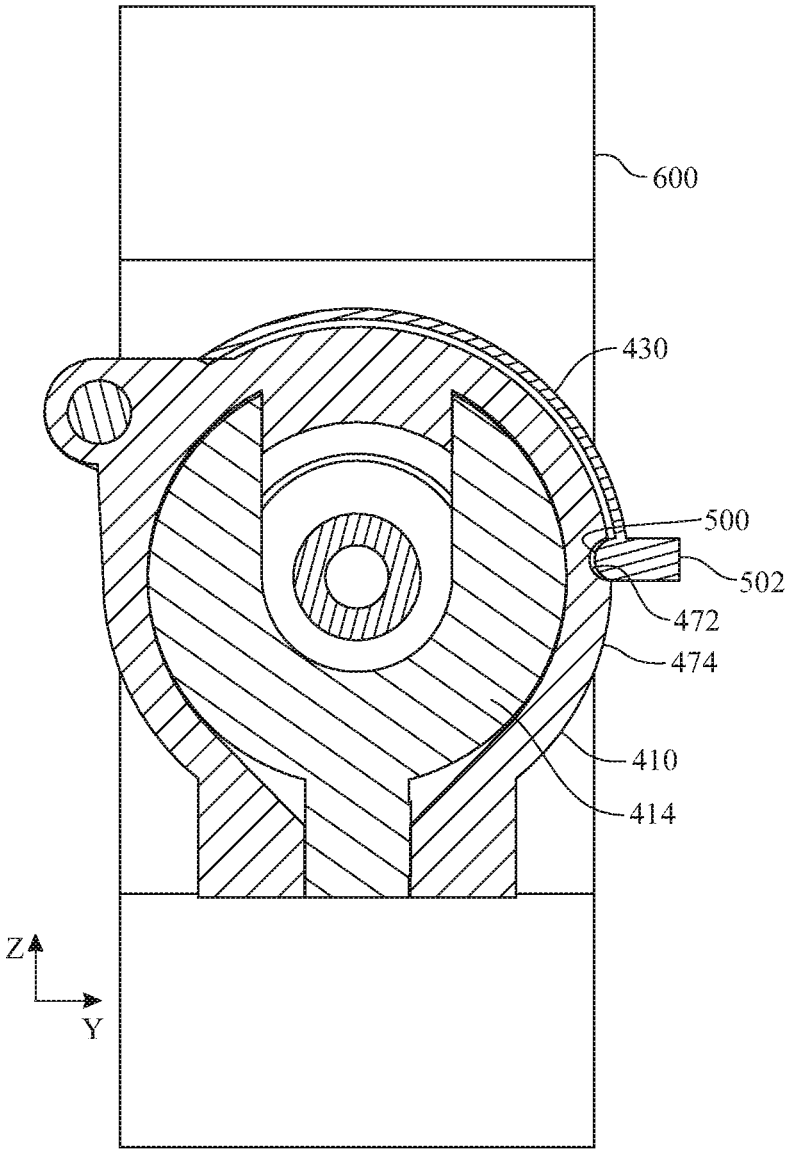
FIG. 16 presents a rear elevation view of the assembly of FIG. 15, the section taken along section plane 16-16 indicated in FIG. 15.

Similarly to the previous embodiment, the clamp member 414 includes a base portion 419 from which first and second arms 416; 418 extend, spaced apart from one another and defining an elongate slot 420 therebetween. An enlarged cavity 484 is formed rearward of the slot 420 and is communicated with the slot 420. Similarly to the previous embodiment, as shown in FIG. 10, the clamp member 414 comprises a seating surface 485 facing rearward, facing the enlarged cavity 484, and encircling the slot 420. However, as also shown in FIGS. 14 and 15, the seating surface 485 of the present embodiment is arranged at an angle other than 90 degrees (and not equal to zero) with inner side walls 416*a* and 418*a* of the first and second arms 416 and 418 defining the slot 420; in other words, the seating surface 485 is tapered. Similarly to the previous embodiment, when the clamp member 414 is in the closed position, the first arm 416, second arm 418 and base portion 419 fit into the central cavity 412 as shown in FIG. 11.

Also similarly to the previous embodiment, the latch member 430 includes a back portion 486 from which first and second sides 488 and 490 extend, spaced apart from one another to define a space therebetween for receiving an upper section of the housing 410. On a free or distal end 502 of the latch member 430; an inward protrusion 500 is configured to engage with a recess or notch 472 on an outer surface 474 of the housing 410; the cross-sectional view of FIG. 16, for instance, shows the latch member 430 in a closed position in which the inward protrusion 500 of the latch member 430 is engaged with the notch 472 of the housing 410, removably securing the latch member 430 in the closed position.

The illustrations of FIGS. 11 through 16 show the adapter device 400 in operation, being used to secure a guitar 600 to a guitar strap 550. The guitar 600 comprises a rear mounting button 620 as known in the art. The mounting button 620 includes a shaft 622 extending outward from an outer surface 624 of the guitar 600 and an enlarged head 626 (enlarged being understood as wider than the shaft 622) formed at an end 628 of the shaft 622. The enlarged head 626 presents an underside 630 which encircles the shaft 622. As best shown in FIGS. 14 and 15, the underside 630 of the present illustrative mounting button 620 is tapered, unlike the underside 312 of the mounting button 302 shown in FIGS. 6 through 8.

Figure 11:
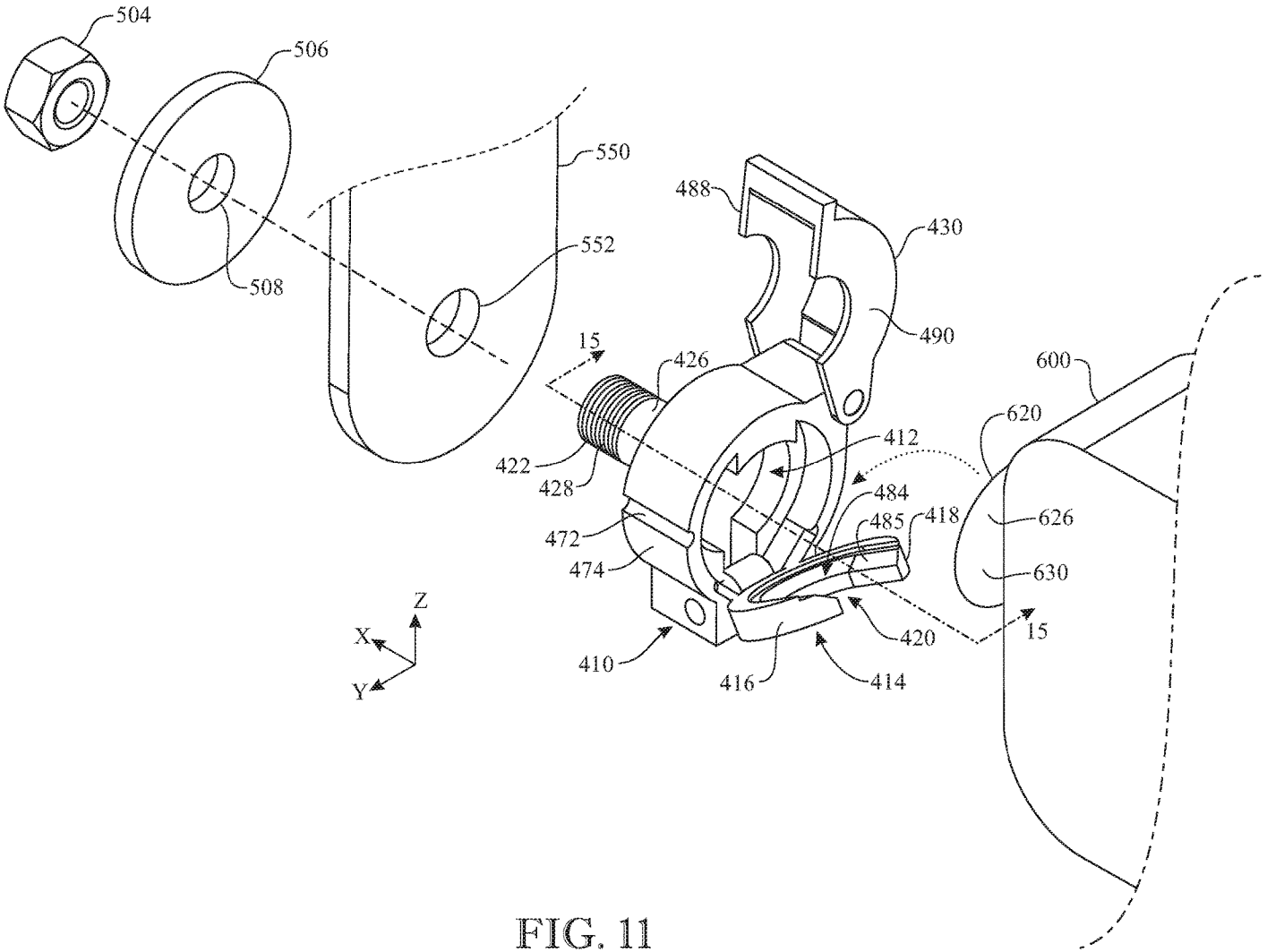
FIG. 11 presents an exploded, top front isometric view of a guitar strap, a washer, a nut, a guitar and the adapter device of FIG. 9, the latter shown assembled, with the clamp member and latch member shown in an open position.
Figure 12:
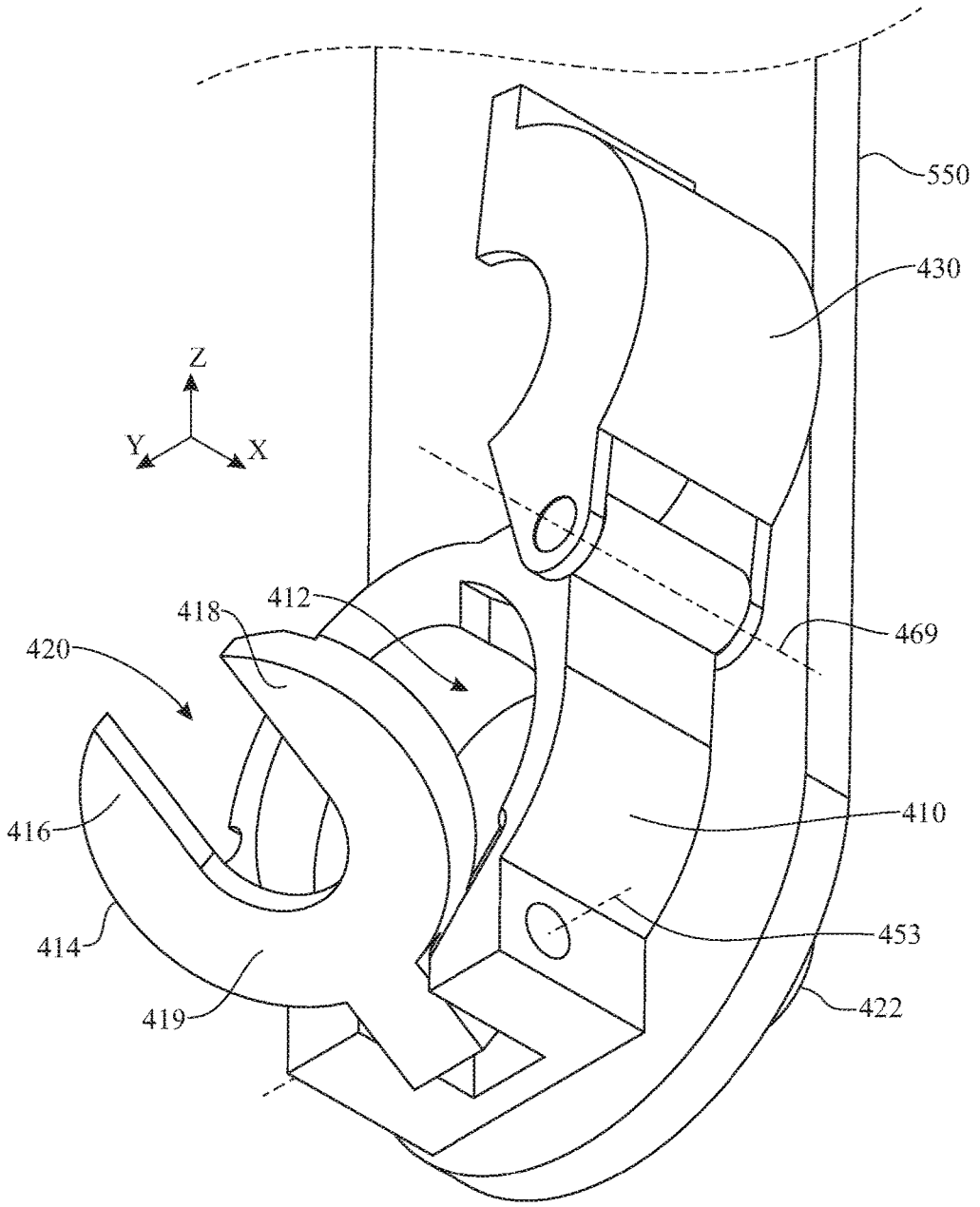
FIG. 12 presents a bottom front isometric view of the parts of FIG. 11, the strap shown secured to the adapter device, wherein the clamp member and latch member are in an open position.
Figure 13:
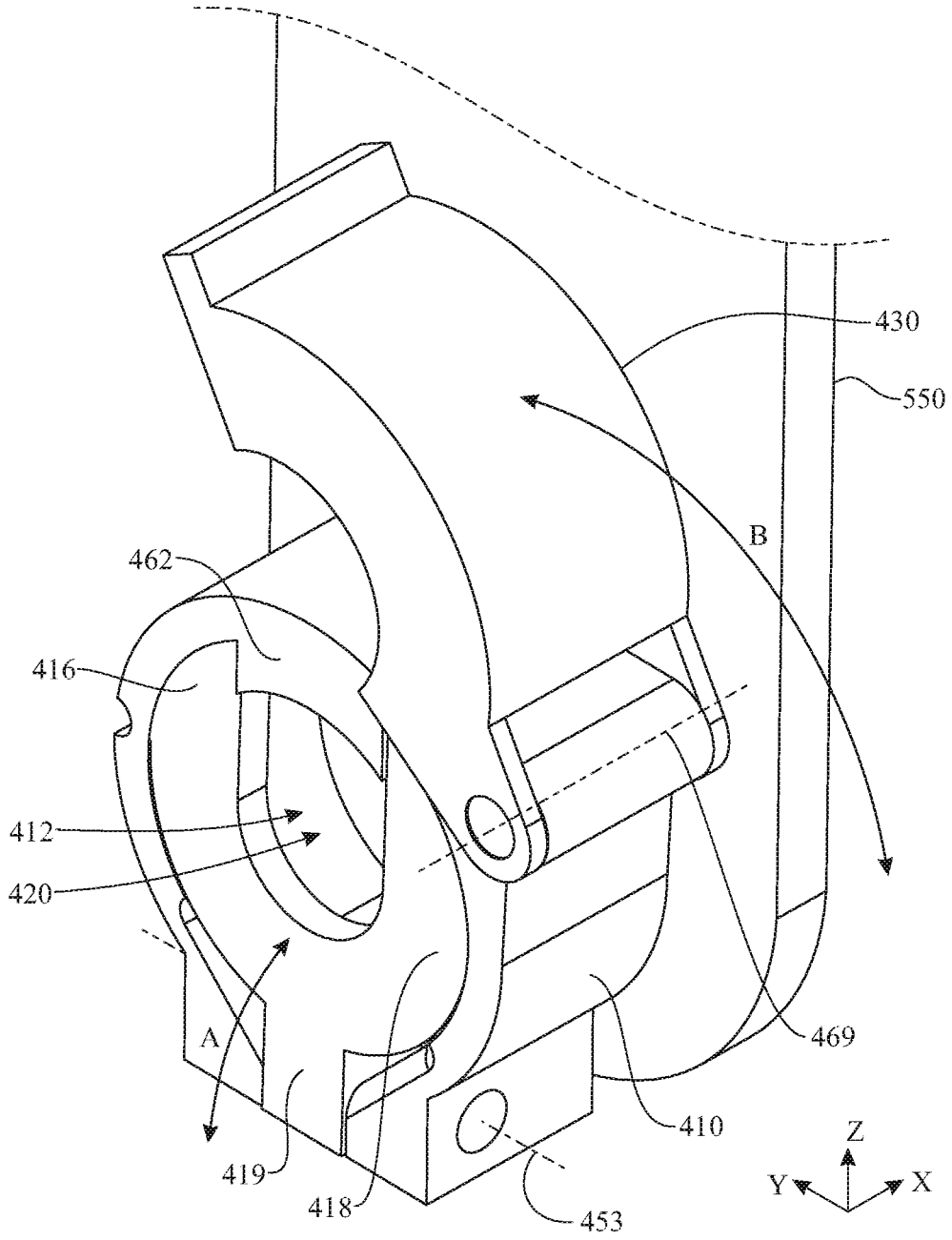
FIG. 13 presents a top front isometric view of the assembly of FIG. 12, wherein the clamp member is in a closed position and the latch member is in an open position.

As shown in FIGS. 11 and 14, a rear strap stud 422 of the adapter device 400 is inserted through a hole 552 of the strap 550 and through a hole 508 of a supporting washer 506, A securing nut 504 is threaded onto a threaded portion 428 of the strap stud 422 which projects rearward from the supporting washer 506, while a non-threaded, smooth portion 426 of the rear strap stud 422 extends through the strap 550. Either before or after attaching the strap 550 to the strap stud 422, the enlarged head 626 of the mounting button 620 is inserted into the enlarged cavity 484 of the clamp member 414 while the shaft 622 of the mounting button 620 extends through the elongate slot 420 of the clamp member 414, as best shown in FIG. 14. Next, the clamp member 414 is pivoted about rotation axis 453 towards the housing 410 to the closed position shown in FIG. 15. In this closed position, the clamp member 414 and the enlarged head 626 of the mounting button 620 are received within the central cavity 412 of the housing 410, while the shaft 622 continues to extend through the slot 420 of the clamp member 414. In addition, as shown in FIGS. 14 and 15 and best shown in FIG. 16, the downward projecting rib 462 extends into the slot 420 contributing to confine the shaft 622 within the slot 420. The latch member 430 is then pivoted about rotation axis 469 towards the housing 410, and fitted onto the housing 410 as shown in FIG. 15. In this fitted position of the latch member 430, the latch member 430, and more particularly the second side 490 of the latch member 430, prevents the clamp member 414 from pivoting away from the housing 410 towards the open position of the clamp member 414 shown in FIG. 14. In the situation of FIG. 15, the enlarged head 626 of the mounting button 620 is retained within the central cavity 412 of the housing 410 by the second side 490 of the latch member 430. The enlarged head 626 is also retained within the central cavity 412 by the tapered seating surface 485 of the clamp member 414, which can contact the underside 630 of the enlarged head 626 in the event that the mounting button 620 is pulled outward, and thus can block the outward pulling of the enlarged head 626.

As shown in FIGS. 10 and 15, the strap stud 422 of the present embodiment further includes a shoulder 429 arranged adjacent to a rear side or surface 424 of the housing 410. The shoulder 429 is wider (e.g., has a larger diameter) than the smooth portion 426 and the threaded portion 428 of the strap stud 422, and is also wider than the hole 552 of the strap 550. The shoulder 429 is also sufficiently long (in the longitudinal direction X) so that it protrudes rearward from the latch member 430. In consequence, as shown in FIG. 15, the strap 550 can rest on the shoulder 429 when attached to the adapter device 400, and is retained in a spaced-apart relationship with the latch member 430 by the shoulder 429. Such spaced-apart relationship allows a user to operate (latch and unlatch) the latch member 430 while the adapter device 400 is attached to a strap 550, greatly facilitating attaching and detaching the strap 550 and adapter device 400 to and from different instruments, for instance and without limitation.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An adapter device for removably securing a carrying strap to a mounting button of a musical instrument, comprising:

a housing defining a frontward-oriented cavity and having a strap stud extending rearward from a rear wall of said housing, said rear wall arranged rearward of said cavity and delimiting said cavity;

a clamp member movably mounted to said housing and defining an elongated, through slot, said slot having a width less than a width of said cavity, said clamp member being reversibly movable relative to said housing from a closed position in which said clamp member and said slot are at least partially positioned within said cavity of said housing, and further in which a space is delimited within said cavity, wherein said space is arranged rearward of and in communication with said slot and is wider than said slot, to an open position in which said clamp member is moved away from said housing and said cavity is exposed to a greater extent than in said closed position; and a latch member movably mounted to said housing, the latch member being movable from an unlocking position moved away from said clamp member and allowing said clamp member to move relative to said housing to a locking position covering a portion of said clamp member in the closed position and retaining said clamp member in said closed position.

2. The adapter device of claim 1, wherein the slot is delimited by opposite inner side walls of the clamp member, wherein the clamp member further comprises a seating surface forming an angle other than zero with said opposite inner side walls and facing the space when the clamp member is in the closed position.

3. The adapter device of claim 1, wherein an inner end of the slot is delimited by a rounded end wall.

4. The adapter device of claim 1, wherein the clamp member comprises an enlarged cavity adjacent to the slot, and further wherein the enlarged cavity is rearward of the slot when the clamp member is in the closed position.

5. The adapter device of claim 1, wherein the clamp member is pivotably connected to the housing.

6. The adapter device of claim 5, wherein the clamp member is pivotable relative to the housing about a rotation axis arranged along a left-to-right, lateral direction of the housing.

7. The adapter device of claim 6, wherein the clamp member further comprises a tapered surface on a base portion of the clamp member, the tapered surface configured to engage the housing to limit the pivoting of the clamp member away from the housing.

8. The adapter device of claim 1, wherein the latch member is pivotably connected to the housing.

9. The adapter device of claim 8, wherein the latch member is pivotable relative to the housing about a rotation axis arranged along a front-to-back, longitudinal direction of the housing.

10. The adapter device of claim 8, wherein the clamp member is pivotably connected to the housing, wherein the clamp member is pivotable about a first rotation axis and the latch member is pivotable about a second rotation axis perpendicular to the first rotation axis.

11. The adapter device of claim 1, wherein the strap stud is at least partially threaded.

12. The adapter device of claim 11, wherein the strap stud comprises a non-threaded portion extending from the rear wall of the housing and a threaded portion extending rearward from the non-threaded portion.

13. The adapter device of claim 12, wherein the non-threaded portion of the strap stud comprises a shoulder extending from the rear wall of the housing, wherein the shoulder is arranged rearward of the latch member when the latch member is in the locking position.

14. The adapter device of claim 1, wherein the clamp member comprises a base portion, a first arm extending from the base portion and a second arm extending from the base portion, the first and second arms defining the elongated slot therebetween.

15. The adapter device of claim 14, wherein the latch member comprises a front side which at least partially covers the first and second arms of the clamp member when the clamp member is in the closed position and the latch member is in the locking position.

16. The adapter device of claim 1, wherein the housing further comprises a notch in an outer surface of the housing and the latch member further comprises an inward protrusion engageable with the notch when the latch member is in the locking position.

17. The adapter device of claim 1, wherein the housing further comprises a downward projecting rib extending from a top side of said housing, wherein the downward projecting rib extends into the slot when the clamp member is in the closed position.

18. An adapter device for removably securing a carrying strap to a mounting button of a musical instrument, comprising:

a housing defining a frontward-oriented cavity and having a strap stud extending rearward from a rear wall of said housing, said rear wall arranged rearward of said cavity and delimiting said cavity;

a clamp member pivotably carried by said housing and defining an elongated, through slot, said slot having a width less than a width of said cavity, said clamp member being reversibly pivotable relative to said housing from a closed position in which said clamp member and said slot are at least partially positioned within said cavity of said housing, and further in which a space is delimited within said cavity, wherein said space is arranged rearward of and in communication with said slot and is wider than said slot, to an open position in which said clamp member is pivoted away from said housing and said cavity is exposed to a greater extent than in said closed position; and a latch member pivotably carried by said housing, the latch member being pivotable from an unlocking position pivoted away from said clamp member and allowing said clamp member to pivot relative to said housing to a locking position covering a portion of said clamp member in the closed position and retaining said clamp member in said closed position.

19. An adapter device for removably securing a carrying strap to a mounting button of a musical instrument, comprising:

a housing defining a frontward-oriented cavity and having a strap stud extending rearward from a rear wall of said housing, said rear wall arranged rearward of said cavity and delimiting said cavity;

a clamp member pivotably carried by said housing about a first rotation axis arranged in a left-to-right, lateral direction, the clamp member comprising an elongated, through slot, said slot having a width less than a width of said cavity, said clamp member being reversibly pivotably relative to said housing from a closed position in which said clamp member and said slot are at least partially positioned within said cavity of said housing, and further in which a space is delimited within said cavity, wherein said space is arranged rearward of and in communication with said slot and is wider than said slot, to an open position in which said clamp member is pivoted away from said housing and said cavity is exposed to a greater extent than in said closed position; and a latch member pivotably carried by said housing about a second rotation axis arranged in a front-to-back, longitudinal direction, the latch member being pivotably from an unlocking position pivoted away from said clamp member and allowing said clamp member to pivot relative to said housing to a locking position covering a portion of said clamp member in the closed position and retaining said clamp member in said closed position.

20. The adapter device of claim 19, wherein said first rotation axis is arranged at a bottom end of said housing and said second rotation axis is arranged at a top end of said housing.

* * * * *